United States Patent [19]

Moreau et al.

[11] 3,942,974

[45] Mar. 9, 1976

[54] MANGANESE NODULE PELLETIZING

[75] Inventors: Eugene J. Moreau, Lincoln, R.I.; Richard S. Opalanko, Billerica, Mass.; Norman Schapiro, Sudbury, Mass.; Robert E. Lueders, Needham, Mass.

[73] Assignee: Kennecott Copper Corporation, New York, N.Y.

[22] Filed: Feb. 10, 1975

[21] Appl. No.: 548,550

[52] U.S. Cl. ..... 75/3; 75/101 R; 75/101 BE; 75/121

[51] Int. Cl.[2] ..... C22B 1/08

[58] Field of Search ..... 75/3, 101 BE, 121

[56] References Cited

UNITED STATES PATENTS

| | | | |
|---|---|---|---|
| 3,309,196 | 3/1967 | Kaneko et al. | 75/94 |
| 3,437,474 | 4/1969 | Imperato | 75/3 |
| 3,617,254 | 11/1971 | Imperato | 75/3 |
| 3,622,301 | 11/1971 | Mehl et al. | 75/3 |
| 3,635,694 | 1/1972 | Chu | 75/3 |
| 3,660,073 | 5/1972 | Youngs et al. | 75/3 |
| 3,682,621 | 8/1972 | von Struve et al. | 75/3 |
| 3,788,841 | 1/1974 | Agarwal et al. | 75/121 X |
| 3,864,118 | 2/1975 | Schumacher et al. | 75/3 |

OTHER PUBLICATIONS

Aase et al., U.S. Bureau of Mines Report of Investigations 7206, Dec. 1968, pp. 1–17.

*Primary Examiner*—G. Ozaki

*Attorney, Agent, or Firm*—John L. Sniado; Lowell H. McCarter; Anthony M. Lorusso

[57] ABSTRACT

Sodium ions are added to manganese nodules to convert the montmorillonite clay naturally occurring in the nodule material into a bonding agent for pelletization into spherical agglomerates.

The addition of coking coal to provide bonding stength after reduction, during which the clay bond is destroyed, is also disclosed.

18 Claims, 1 Drawing Figure

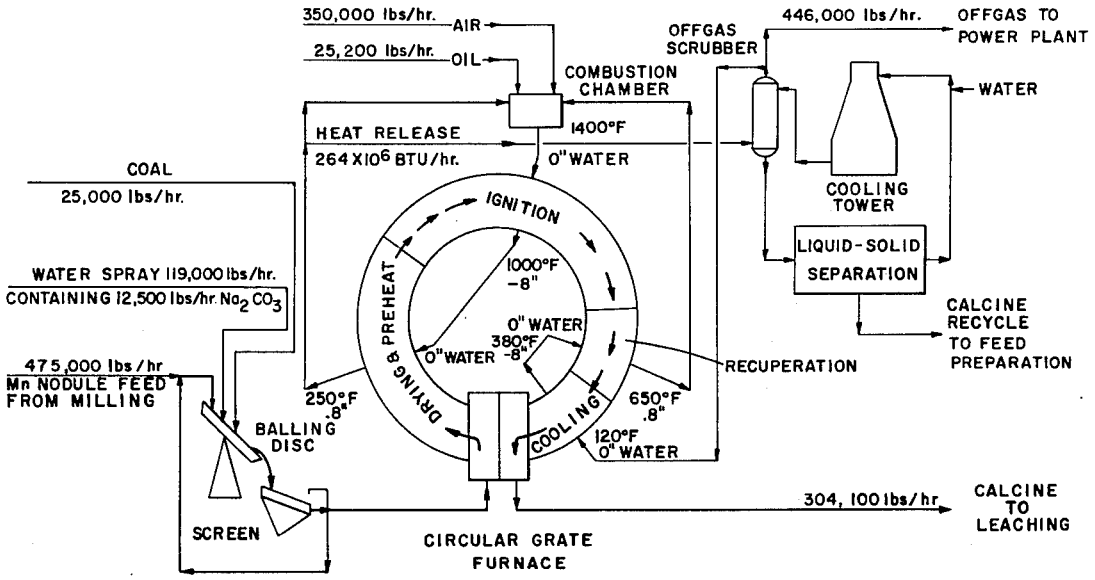

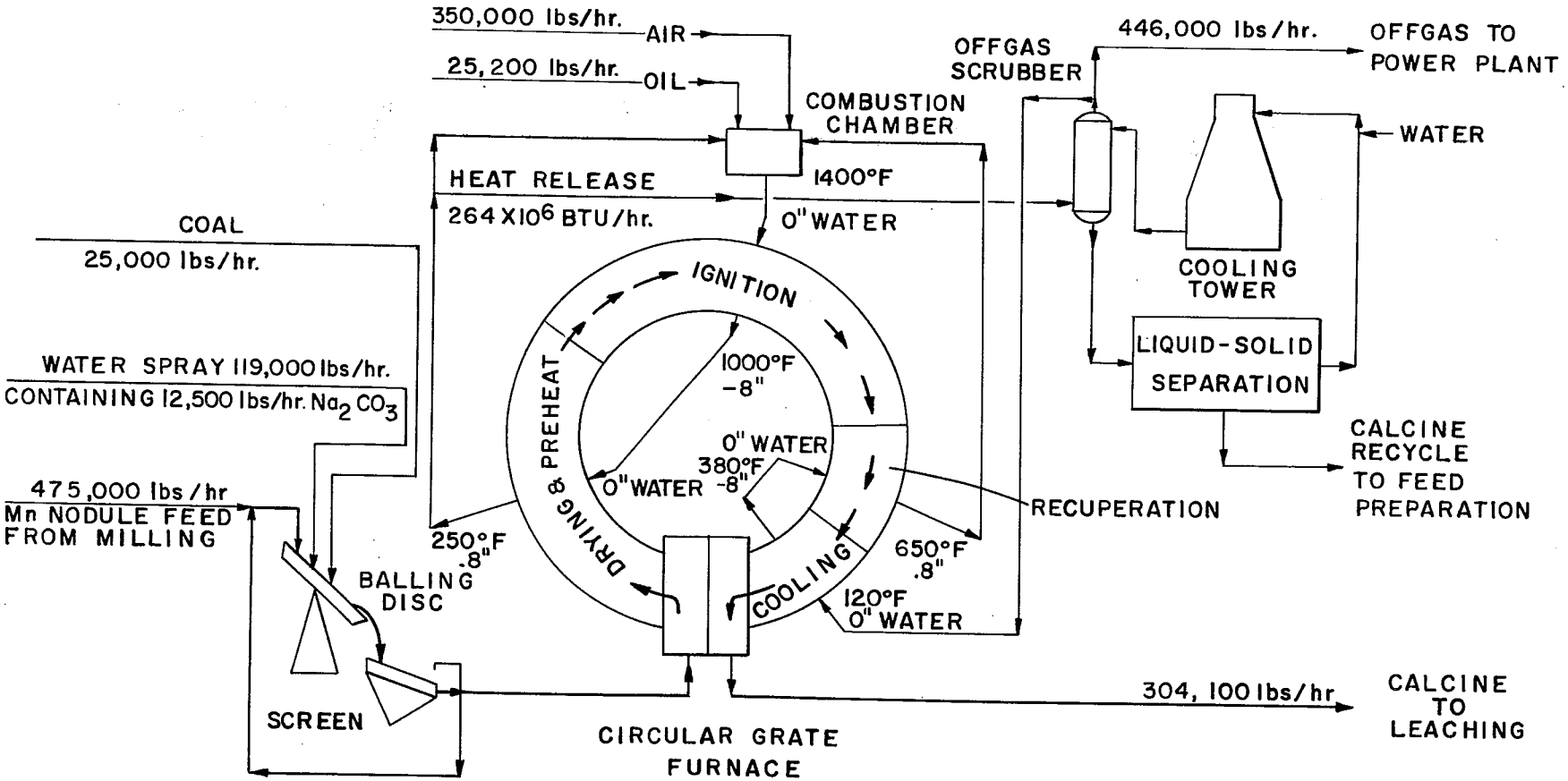
OFFGAS TO POWER PLANT
WATER
446,000 lbs/hr.
COOLING TOWER
LIQUID-SOLID SEPARATION
CALCINE RECYCLE TO FEED PREPARATION
CALCINE TO LEACHING
304,100 lbs/hr.
OFFGAS SCRUBBER
RECUPERATION
COMBUSTION CHAMBER
1400°F
0" WATER
650°F
.8"
120°F
0" WATER
COOLING
IGNITION
1000°F
-8"
0" WATER
380°F
-8"
0" WATER
DRYING & PREHEAT
350,000 lbs/hr.
AIR
25,200 lbs/hr.
OIL
HEAT RELEASE
264 X10^6 BTU/hr.
250°F
.8"
CIRCULAR GRATE FURNACE
BALLING DISC
SCREEN
COAL
25,000 lbs/hr.
WATER SPRAY 119,000 lbs/hr.
CONTAINING 12,500 lbs/hr. Na2 CO3
475,000 lbs/hr
Mn NODULE FEED FROM MILLING

MANGANESE NODULE PELLETIZING

BACKGROUND OF THE INVENTION

The present invention relates to a pelletizing step in a process for recovering metals such as copper, nickel, molybdenum and cobalt from manganese deep sea nodules. For the purpose of this patent specification and claims, complex ores which are found on the deep sea floor of oceans and lakes containing manganese, iron, copper, nickel, molybdenum, cobalt and other metal values are variously referred to as deep sea manganese nodules, manganese nodules or nodules.

Ocean floor deposits are found as nodules, loose-lying at the surface of the soft sea floor sediment, as grains in the sea floor sediments, as crusts on ocean floor hard rock outcrops, as replacement fillings in calcareous debris and animal remains, and in other less important forms. Samples of this ore material can readily be recovered on the ocean floor by drag dredging, a method used by oceanographers for many years, or by deep sea hydraulic dredging, a method that could be used in commercial operation to mine these deposits. Mechanical deep sea nodule harvesters are described in U.S. Pat. Nos. 3,480,326 and 3,504,943.

The character and chemical content of the deep sea nodules may vary widely depending upon the region from which the nodules are obtained. The Mineral Resources of the Sea, John L. Mero, Elsevier Oceanography Series, Elsevier Publishing Company 1965, discusses on pages 127–241 various aspects of manganese nodules. For a detailed chemical analysis of nodules from the Pacific Ocean see pages 449 and 450 in The Encyclopedia of Oceanography, edited by R. W. Fairbridge, Reinhold Publishing Crop., N.Y. 1966, and U.S. Pat. No. 3,169,856. For the purpose of this invention, the complex ores will be considered as containing the following approximate metal content range on a dry basis:

METAL CONTENT ANALYSIS RANGE

| | | | |
|---|---|---|---|
| Copper | 0.8 | – | 1.8% |
| Nickel | 1.0 | – | 2.0% |
| Cobalt | 0.1 | – | 0.5% |
| Molybdenum | 0.03 | – | 0.1% |
| Manganese | 10.0 | – | 40.0% |
| Iron | 4.0 | – | 25.0% |

The remainder of the ore consists of oxygen as oxides, clay minerals (such as montmorillonite) with lesser amounts of quartz, apatite, biotite, sodium and potassium feldspars and water of hydration. Of the many ingredients making up the manganese nodules, copper and nickel are emphasized because, from an economic standpoint, they are the most significant metals in most of the ocean floor ores.

In U.S. Pat. No. 3,788,841, entitled Recovery of Metal Values from Manganese Nodules, the teachings of which are incorportated herein by reference, the desirability of pelletizing manganese nodules prior to pyrometallurgical treatment is disclosed. By pelletizing the nodule feed, prior to pyrometallurgical treatment, many advantages result. For example, pelletization produces a coarse material which is more easily handled during the reduction stage of the process. Pelletization also increases the intimacy of the reductant when added with the nodule material prior to pelletizing. Pelletization also minimizes the presence of fines which can be troublesome during the leaching stages of the process. Furthermore, pelletization of the nodules contributes to the production of tailings which are more easily disposable.

Pelletization per se is well known in the smelting art. Typically, balls or green balls are made by feeding ground ore, additives and moisture independently on to a rotating pan, disc or drum. Agglomerates are also made by mixing the ground ores, additives and moisture, and pressing the mixture into the form of pellets or briquettes. The terms "balls" and "pellets" will be used interchangeably throughout this specification.

A common additive which serves as a bonding agent for the pellets is a sodium bentonite. High sodium bentonite swells upon water addition making the clay useful as a binding agent. Bentonites are composed chiefly of montmorillonites which are clay minerals generally distinguished from other clay minerals by their surface activity and extremely fine particle sizes.

The general formula for montmorillonite is $$(\tfrac{1}{2}\,Ca,\ Na,)_{0.7}\ (Al,Mg,Fe)_4\ (Si,Al)_8\ (OH)_8.nH_2O;$$

the general formula for high sodium montmorillonite is $Na_{0.7}(Al,Mg,Fe)_4\ (Si,Al)_8\ (OH)_4.nH_2O$; and, the general formula for high calcium montmorillonite is $\tfrac{1}{2}\ Ca_{0.7}\ (Al,Mg,Fe)_4(Si,Al)_8\ (OH)_4.nH_2O$.

Bentonites are defined as fine grained clays containing not less than 85% montmorillonite. Two broad divisions of bentonites are sodium bentonite (which expands in water and contains sodium as its predominant exchangeable ion) and calcium bentonite (which has negligible swelling and carries calcium as its principal exchangeable ion).

Of course, it would be an economic advantage to be able to produce strong pellets of manganese nodules without the extra expense of adding a bonding agent such as sodium bentonite.

In short, if a bonding agent such as sodium bentonite is eliminated from the pelletizing procedure, weak pellets result. On the other hand, adding sodium bentonite to the manganese nodule material increases the cost of producing the pellets.

SUMMARY OF THE INVENTION

In accordance with the present invention, a sodium activator is utilized to provide $Na^+$ ions to activate the calcium montmorillonite clay, which occurs naturally in the nodules, into a bonding material that improves dry and green strength in agglomeration.

In one important embodiment of the invention, coking coal is added to the nodule material prior to pelletizing to provide both a reducing agent and a coke bond to maintain the agglomerate shape during and after reduction. The coke produced during reduction also creates a more porous pellet, improving the pellet's leaching characteristics.

Accordingly, an object of the present invention is to exchange $Na^+$ for $Ca^{++}$ ions in the calcium montmorillonite clay material, which occurs in manganese nodules, and thereby convert the calcium montmorillonite into sodium bentonite which acts as a bonding agent to strengthen the pelletized nodules.

Another object of the invention is to provide a convenient and easily handled shape (spherical pellet) in which manganese nodule materials can be reduced, leached, and otherwise processed to recover the metals contained therein.

Another object of the present invention is to provide strong manganese pellets at a low cost.

A more specific object of the invention is to form manganese nodules into pellets having a strength sufficient to undergo the necessary mechanical handling and yet porous enough to be efficiently reduced and leached.

BRIEF DESCRIPTION OF THE DRAWING nodules

The sole FIGURE of the drawing is a flow chart for processing manganese smoules and shows quantities of materials for forming pellets in accordance with the present invention.

DESCRIPTION OF THE PREFERRED EMBODIMENTS

At the outset, the process of the present invention is described in its broadest overall aspects with a more detailed description following. In accordance with the present invention, the calcium ions in the montmorillonite present in manganese nodules are exchanged by sodium ions. The foregoing ion exchange enables the clay materials present in the nodules to be utilized to strengthen pellets produced during pelletization.

Bentonite clays, composed of no less than 85% montmorillonite, may have adsorbed ions which are capable of "base exchange". These ions are either Na or Ca, with lesser amounts of Al, Mg, and Fe. If the clay has a large amount of Na ions (high sodium bentonite), the Na ions in the clay can be exchanged for aqueous Ca ions. This action is defined as "base exchange" capability. If the clay contains a large amount of Ca ions, the reverse reaction occurs.

High sodium bentonite swells upon water addition making the clay useful as a binding agent during pelletization. High calcium bentonite is non-swelling; but, in accordance with the present invention, it can be made swelling by contacting the clay with aqueous Na ions, initiating the base exchange phenomenon.

The clay found in manganese nodules is high calcium montmorillonite, $(Ca,MG)O.Al_2O_3.5SiO_2.nH_2O$. This clay can be used to bond the pulverized nodule in pelletizing by the addition of soluble sodium salts, preferably NaOH or $Na_2CO_3$ to "activate" the clay. The sodium compound may be either dissolved in the pelletizing water spray or dry mixed with the nodule feed. Additional amounts of bentonite may also be necessary depending on the amount of clay naturally occurring in the nodule material.

The clay bond will hold the pellet until reduction, at which point the elevated temperatures should break the bond. Final destruction of the montmorillonite lattice begins at about 600°C immediately following the loss of (OH) lattice water, and is essentially complete at 800° to 850°C. If coking coal is used, in whole or in part, as the reducing agent, a coke bond will form during reduction to give the pellet strength through the leaching step.

The manganese nodules as received will vary in mean diameter from about 10 inches to about ½ inch. Therefore, the first step in the processing is to reduce the size of the nodules. The nodules may be screened and the larger nodules broken up in a log washer or similar device. Rod mills or other devices may also be used to wet grind the raw nodules. The nodules when drained contain about 32% by weight moisture.

In some processing schemes, it is desirable to dry the nodules at some step in the process. This may be prior to grinding, during grinding, or after agglomerating. The drying may be accomplished by any of the currently available dryers such as continuous through-circulation dryers or direct rotary dryers. It is possible to grind and dry the nodules simultaneously using a ring-roller or a pebble mill. With such devices, the wet nodules are pulverized while in contact with hot air or a hot gas.

The manganese nodules may be ground to a size between the range of minus 6 mesh to minus 200 mesh sieve, U.S. Sieve Series. Overall economics favor utilizing crushed nodules ranging in size from minus 40 mesh to about minus 120 mesh. Development work has indicated that nodules ground to 90% minus 100 mesh is the most desirable feed stock for the pelletizing or balling operation.

After crushing and/or grinding, the nodules are agglomerated to form green balls or pellets of a substantially uniform preselected size between about 3/32 inch and 1 inch, preferably about ⅜ inch in diameter. Balls or green balls are made by feeding the ground nodules, and water independently to a rotating pan, disc or drum. As is stated above, the sodium activator may be included with the ground nodules or dissolved in the water. Agglomerates are also made by mixing the ground nodules, sodium activator and water, and pressing the mixture into the form of pellets or briquettes.

Preferably, the green balls are produced on a disc pelletizier. The disc pelletizer is advantageously mounted on a compound table which has a three dimensional adjustment. With the disc in counter-clockwise rotation, a screw feeding mechanism is mounted to discharge onto the disc pelletizer between the 3 to 4 o'clock position on the disc. A water spray is adjustably mounted between the 6 to 8 o'clock position. The disc angle is preferably between about 40° and 60° with respect to the horizontal with an angle of 55° having been found the most effective for 90% minus 100 mesh ground nodules.

When agglomerates or pellets are prepared on a disc, the pellet size can be controlled by controlling the residence time of material on the disc. Hold-up time on the disc may be decreased by increasing the disc angle and speed thereby producing smaller size pellets. Pellet size is best controlled by location of the water spray and disc angle. Pellet size will decrease as water spray is moved above the 3 o'clock feed position. Moving the spray up on the rotating disc tends to form more seeds from the fine material carried up thereby increasing the number of pellets formed at the expense of decreasing the pellet size. Seeds mature into pellets as they roll over the top and into the powder feed path. Decreasing the nodule and water feed rates, while holding other variables constant will also increase the pellet size because fewer seeds will be formed. The heating process after pelletization renders the pellets porous as the water and other volatile materials depart from the pellets.

Experience has shown that pellets or green balls of substantially spherical configuration are preferred. A spherical configuration is generally easier to make and has a greater strength than agglomerates of other shapes. Since the physical characteristics of nodules mined from the ocean bed vary from place to place, to produce optimum pellet shape, it is necessary to operate with an experimentally determined moisture content, which is suitable for the particular ocean floor nodules being used. For example, it may be necessary to add between from about 20% to about 40% by weight of water. When the nodules are ground wet and agglomerated while still wet, it may be necessary to decrease the moisture content to obtain the desired agglomerate or pellet characteristics. Pellets containing from about 26 to 30% by weight water have the most preferred physical characteristics for processing in this invention.

As has been set forth above, pelletization in accordance with the present invention includes the addition of a sodium activator to render the montmorillonite clay, which is naturally present in the nodules, to be usable to increase the strength of the pellets.

In accordance with the present invention, the sodium activator is added to the nodule material in either the dry state before pelletizing, or the sodium activator is dissolved in the pelletizing water spray. Of course, a combination of the foregoing techniques may be employed to add the sodium activator to the nodule material.

As has been set forth above, sodium ions are exchanged for the calcium ions which are present in the clay materials of the nodules. Thus, the sodium activator material may be any ionic material which includes sodium ions. Suitable sources for the sodium ions include: sodium carbonate, $Na_2CO_3$; sodium hydroxide, NaOH; and, any soluble sodium salt.

The amount of sodium activator that is added to the ground nodule material to produce the pellets will vary depending upon the composition of the nodule material being treated. Since the chemical composition of nodules mined from the ocean bed varies from place to place, it is necessary to determine the amount of the sodium activator by running a bench scale test on the nodule material. As used throughout this specification and claims, all percentages are by weight unless specified otherwise.

Optimum results are obtained if all the calcium ions in the clay material of the nodules are replaced by sodium ions. Generally this is accomplished by providing two moles of sodium ions from the sodium activator for each mole of calcium ions in the nodule clay. Some nodule material may not have a sufficient amount of calcium montmorillonite to produce suitable pellets even if all the calcium is replaced by sodium ions. In such cases, an additional binder may be added to the pelletizing mixture. For example, if too little calcium montmorillonite clay is present in the nodule material, additional calcium montmorillonite may be added to the pelletizing mixture. Of course, the amount of sodium activator added will be calculated on the basis of the total amount of calcium montmorillonite, that is, the amount originally present in the nodule material plus the amount of calcium montmorillonite added.

Of course, if economical, the sodium exchanged calcium montmorillonite present in the nodules may be supplemented with sodium bentonite. In this embodiment, no additional sodium activator, other than that necessary to activate the clay already present in the nodule material, is added.

As is stated above, in one important embodiment of the invention, coking coal is added to the nodule material prior to pelletizing to provide both a reducing agent and a coke bond to maintain the agglomerate shape during and after reduction. The addition of coking coal also results in a more porous pellet which improves the pellets leaching characteristics.

The invention is further illustrated by the following examples. At this point it should be noted that the invention is not intended to be limited to the procedure set forth in the examples which follow, but rather these examples are provided in order to teach one skilled in the art how to practice the invention and are not intended to limit the invention in any way.

EXAMPLE I

Manganese nodules, which may contain 0–20% by weight calcium montmorillonite, are ground to approximately 90% −60 mesh. Additional calcium montmorillonite or sodium bentonite is mixed with the ground nodule material as necessary to provide sufficient pellet dry green strength. The ratio of added calcium montmorillonite/sodium bentonite will depend on the availability of each at the plant location and overall process economics. Also mixed with the ground nodule material is 1–30% sodium activator ($Na_2CO_3$, NaOH, etc.) by weight of total calcium montmorillonite and 4–12% coking coal by weight of nodule material. The coal is in the size range of 90% −60 mesh. An amount of sodium activator equal to 3–10% by weight of the calcium montmorillonite is preferred. The mix is then agglomerated on a pelletizing disc with water spray in the manner set forth above.

EXAMPLES 2 – 16

Ground Mn nodule material (−60 mesh) was pelletized on an 8 inch laboratory disc pelletizer in a batch operation. When coal, fuel oil, lime, or bentonite was added they were mixed into the ground dry nodule material before pelletizing. The clay activators, NaOH or $Na_2CO_3$, were dissolved in water and sprayed with a hand atomizer onto the pelletizing disc during agglomeration. The pellets were then dried before reduction.

Two types of bentonite were used, Fisher Scientific U.S.P. Bentonite and industrial Wyoming bentonite. Although no chemical analysis was supplied with the Fisher bentonite it is presumed to be a high calcium bentonite because it gave extra strength (15 lb.) when pelletized with activator and no strength when pelletized with water. The Wyoming bentonite, a high sodium bentonite, was only pelletized with water, with which it provided 15+ lb. compression strength.

Reduction was performed in a laboratory tube furnace with nitrogen purge. Maximum temperatures and soak times are shown in the table. Heat up times were 15 minutes, except as noted.

Compression testing was performed by lowering a motor driven weight onto each pellet which sat on a direct reading scale. The scale reading at pellet fracture was the compression strength. The average compression strength of five pellets is reported for each example in the table.

Clay activators used were NaOH and $Na_2CO_3$. Additional clay (bentonite) was mixed in some batches. The wet green pellets were dried and reduced with coal or oil as the reducing agent or heated with no reducing agent. The results of these runs are summarized in the table.

TABLE I

CLAY ACTIVATION

| Example | Nodule Size Dist. | Activator % by wt. nodules | Reducing Agent % by wt nodules | Other Additives | Pellet Size | Green Strength | Reduction Time Temp. | Reduced Strength |
|---|---|---|---|---|---|---|---|---|
| 2 | −60 Mesh | $Na_2CO_3$ 3% | — | — | 3/8" | 10+lb. | 10 min. 750°C | 10+lb. |
| 4 | −60 | $Na_2CO_3$ 3% | Bunker C 7% | — | 3/8" | <1 lb. | 10 min. 750°C | <1 lb. |
| 5 | −60 | $Na_2CO_3$ 1% | — | Bentonite (U.S.P.)2% | 3/8" | 10+ | 30 min. 750°C | 3 |
| 6 | −60 | $Na_2CO_3$ 1% | Bunker C 7% | Bentonite (U.S.P.)3% | 3/8" | 10+ | 10 min. 750°C | 2 |
| 7 | −60 | NaOH 2% | — | — | 3/8" | 10+ | 10 min. 750°C | 10+ |
| 8 | −60 | NaOH 3% | Bunker C 7% | — | 3/8" | 3 | 10 min. 750°C | <1 |
| 9 | −60 | NaOH 1% | — | Bentonite (U.S.P.)2% | 3/8" | 10+ | 30 min. 750°C | 10+ |
| 11 | −60 | NaOH 1% | Bunker C 7% | Bentonite (U.S.P.)2% | 3/8" | 10+ | 10 min. 750°C | <1 |
| 12 | −60 | NaOH 3% | Coal 8% −45 Mesh | — | 3/8" | <10 | 120 min. 750°C | 3 |
| 13 | −60 | NaOH 3% | Coal 10% −60 Mesh | — | 3/8" | <10 | 60 min. 750°C | 5 |
| 14 | −60 | NaOH 3% | Coal 10% −60 Mesh | — | 3/8" | 10+ | 60 min. 750°C | 5 |
| 15 | −60 | NaOH 1% | Coal 10% −60 Mesh | Bentonite (U.S.P.)2% | 1/2" | 15+ | 60 min. 750°C | 15+ |
| 16 | −60 | — | — | Bentonite (U.S.P.)3% | 1/2" | 2 | 10 min. 750°C | <1 |

Example 3 performed by adding 10% bunker C oil to green pellet of example 2. Reduced pellets failed at 3 lb.

Example 10 performed by adding bunker C oil to green pellet of Example 9. Reduced pellets failed at 3 lb.

Example 13 performed with 60 min. heat up to 750°C.

Example 15 performed with 40 min. heat up to 750°C.

EXAMPLE 17

The sole FIGURE of the drawing is a flow sheet for a plant designed to process 5,000 tons per day of manganese nodules. The quantities of materials needed to form pellets in accordance with the present invention are shown in the drawing. Nodule feed, coal and water spray containing the sodium activator ($Na_2CO_3$) are mixed in a balling disc. The pellets formed in the balling disc are then reduced in a reducing furnace such as a circular travelling grate furnace. The calcined nodules leaving the reducing furnace are then leached in an ammoniacal leach liquor containing 50–150 grams per liter $NH_3$ and 20–132 grams per liter $CO_2$. As a result of the reduction and leaching, the metal values such as copper, nickel, cobalt and molybdenum are dissolved in the leach liquor. The nodule tailings are separated from the pregnant liquor. The pregnant liquor is sent to a liquid ion exchange extraction circuit where the metal values are separated from each other and from the leach liquor.

In one preferred embodiment of the invention, the nickel and copper values are extracted from the pregnant liquor, with the cobalt and molybdenum being precipitated from the raffinate. For details of a procedure which can be employed to extract the copper and nickel, see U.S. Pat. No. 3,853,725 entitled Selective Stripping Process by Roald R. Skarbo, filed June 28, 1972, the teachings of which are incorporated herein by reference. The copper and nickel values are recovered by electrowinning. Leaching and recovery of metal values, however, form no part of the present invention.

Details pertaining to the metal values are shown below.

| Nodules Analysis (Dry Basis) In % By Weight | |
|---|---|
| Mn | 30.0 |
| Fe | 5.96 |
| Cu | 1.29 |
| Ni | 1.49 |
| Co | 0.24 |
| Mo | 0.06 |
| Other | Balance |
| **Calcine to Leaching In % By Weight** | |
| Mn | 40.3 |
| Fe | 8.01 |
| Cu | 1.69 |
| Ni | 2.01 |
| Co | 0.32 |
| Mo | 0.08 |
| Other | Balance |
| **Tailings In % By Weight** | |
| $2MnO.SiO_2$ | 10.5 |
| $MnCO_3$ | 23.9 |
| Cu | ~ 0.4 |
| Ni | ~ 0.4 |
| Co | ~ 0.3 |
| Mo | negligible |
| Free $H_2O$ | 40 |
| Other | Balance |
| **Pregnant Liquor** | |
| Cu | 7.0 gm/l |
| Ni | 7.3 gm/l |
| Co | 0.78 gm/l |
| Mo | 0.40 gm/l |
| $NH_3$ | 100 gm/l |
| $CO_2$ | 68 gm/l |

SUMMARY

By following the teachings of the present invention it is possible to utilize the clay material in the nodule to produce strong pellets having green and reduced strengths of 10+ lbs. The clay material in the nodules is rendered usable as a bonding agent by the addition of a sodium activator. Numerous tests have indicated that the source of the sodium ions has little or no effect on green and reduced strengths.

Tests have also indicated that the use of fuel oil as a reducing agent adversely effects green and reduced strength. Thus, coking coal is advantageously employed as a reducing agent for pellets formed in accordance with the present invention. However, satisfactory green strength can be achieved with fuel oil by adding 2% bentonite to the nodules and by replacing the calcium ions in the nodules and the bentonite with sodium ions. If a high sodium bentonite is added to the nodules only 1% is needed to obtain a 15 lb. compression strength nodule with fuel oil, provided the calcium ions in the nodule clays are replaced by sodium ions.

Excellent results are obtained by utilizing both coal and bentonite, that is 10% coal, 1% sodium hydroxide and 2% bentonite. Coal size distribution should be of the same order as ground nodule size distribution to achieve the best strength. The operable weight % of $Na^+$ ions needed to achieve the swelling of the montmorillonite in the nodule is 0.6% of the nodule material.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. In a process in which manganese nodules are reduced and subsequently leached to extract metal values therefrom wherein the improvement comprises pelletizing the manganese nodules prior to the reduction and leaching by the following steps:

a. grinding the nodules;

b. base exchanging the calcium montmorillonite in the nodules with sodium ions;

c. agglomerating the ground nodules to form pellets.

2. The process as set forth in claim 1 wherein in step (a) the nodules are ground to have a particle size of 90% −100 mesh.

3. The process as set forth in claim 2 including the step of adding 4–12% by weight of the nodules of coking coal prior to agglomerating the nodules.

4. The process as set forth in claim 3 wherein the coking coal is in a size range corresponding to the size range of the ground nodules.

5. The process as set forth in claim 1 wherein approximately two moles of sodium ions are provided for each mole of calcium ions in the montmorillonite for the base exchange which takes place in step (b).

6. The process as set forth in claim 5 including the step of adding 4–12% by weight of the nodules of coking coal prior to agglomerating the nodules.

7. The process as set forth in claim 6 wherein the coking coal is in a size range corresponding to the size range of the ground nodules.

8. The process as set forth in claim 1 wherein the source of sodium ions, base exchanged in step (b), is a member selected from the group consisting of sodium hydroxide and sodium carbonate.

9. The process as set forth in claim 8 including the step of adding 4–12% by weight of the nodules of coking coal prior to agglomerating the nodules.

10. The process as set forth in claim 9 wherein the coking coal is in a size range corresponding to the size range of the ground nodules.

11. The process as set forth in claim 1 wherein the source material for sodium ions is mixed with ground nodules prior to agglomeration.

12. The process as set forth in claim 11 including the step of adding 4–12% by weight of the nodules of coking coal prior to agglomerating the nodules.

13. The process as set forth in claim 12 wherein the coking coal is in a size range corresponding to the size range of the ground nodules.

14. The process set forth in claim 1 wherein the sodium source material is dissolved in water and the water containing the sodium ions is sprayed on the ground nodules during the agglomeration step.

15. The process as set forth in claim 14 including the step of adding 4–12% by weight of the nodules of coking coal prior to agglomerating the nodules.

16. The process as set forth in claim 15 wherein the coking coal is in a size range corresponding to the size range of the ground nodules.

17. The process as set forth in claim 1 including the step of adding 4–12% by weight of the nodules of coking coal prior to agglomerating the nodules.

18. The process as set forth in claim 17 wherein the coking coal is in a size range corresponding to the size range of the ground nodules.

* * * * *